US005425463A

United States Patent [19]

Toscanini et al.

[11] Patent Number: 5,425,463

[45] Date of Patent: Jun. 20, 1995

[54] TIE-HOLDER DEVICE

[75] Inventors: Ettore Toscanini; Giovanni Toscanini, both of Borgosesia, Italy

[73] Assignee: Industrie Toscanini SaS, Borgosesia, Italy

[21] Appl. No.: 153,040

[22] Filed: Nov. 17, 1993

[30] Foreign Application Priority Data

Nov. 17, 1992 [IT] Italy ..... MI92A2626
Nov. 17, 1992 [IT] Italy ..... MI92U0995 U

[51] Int. Cl.[6] ..... A47F 5/00
[52] U.S. Cl. ..... 211/96; 211/104
[58] Field of Search ..... 211/96, 104, 94, 87, 211/162

[56] References Cited

U.S. PATENT DOCUMENTS 1,913,215 6/1933 Schwartz et al. ..... 211/96 X
2,061,156 11/1936 Humphrey ..... 211/96
2,499,159 2/1950 Pestyner ..... 211/96
2,515,293 7/1950 Carter ..... 211/96 X
2,582,127 1/1952 Hort ..... 211/96 X
2,603,359 7/1952 Pestyner ..... 211/104 X
2,609,935 9/1952 Kruger ..... 211/96
2,724,510 11/1955 Williams ..... 211/96 X
4,569,450 2/1986 Dillingham ..... 211/96

*Primary Examiner*—Robert W. Gibson, Jr.
*Attorney, Agent, or Firm*—Sughrue, Mion, Zinn, Macpeak & Seas

[57] ABSTRACT

A tie-holder device comprises a support frame and a plurality of hooks rotatably mounted on the support frame and having respective crank-shaped ends associated with a driving bar. The support frame comprises an elongated box-like body which has a supporting function and at the same time encapsulates and protects all the mechanisms of the device.

14 Claims, 6 Drawing Sheets

TIE-HOLDER DEVICE

Figure 1:
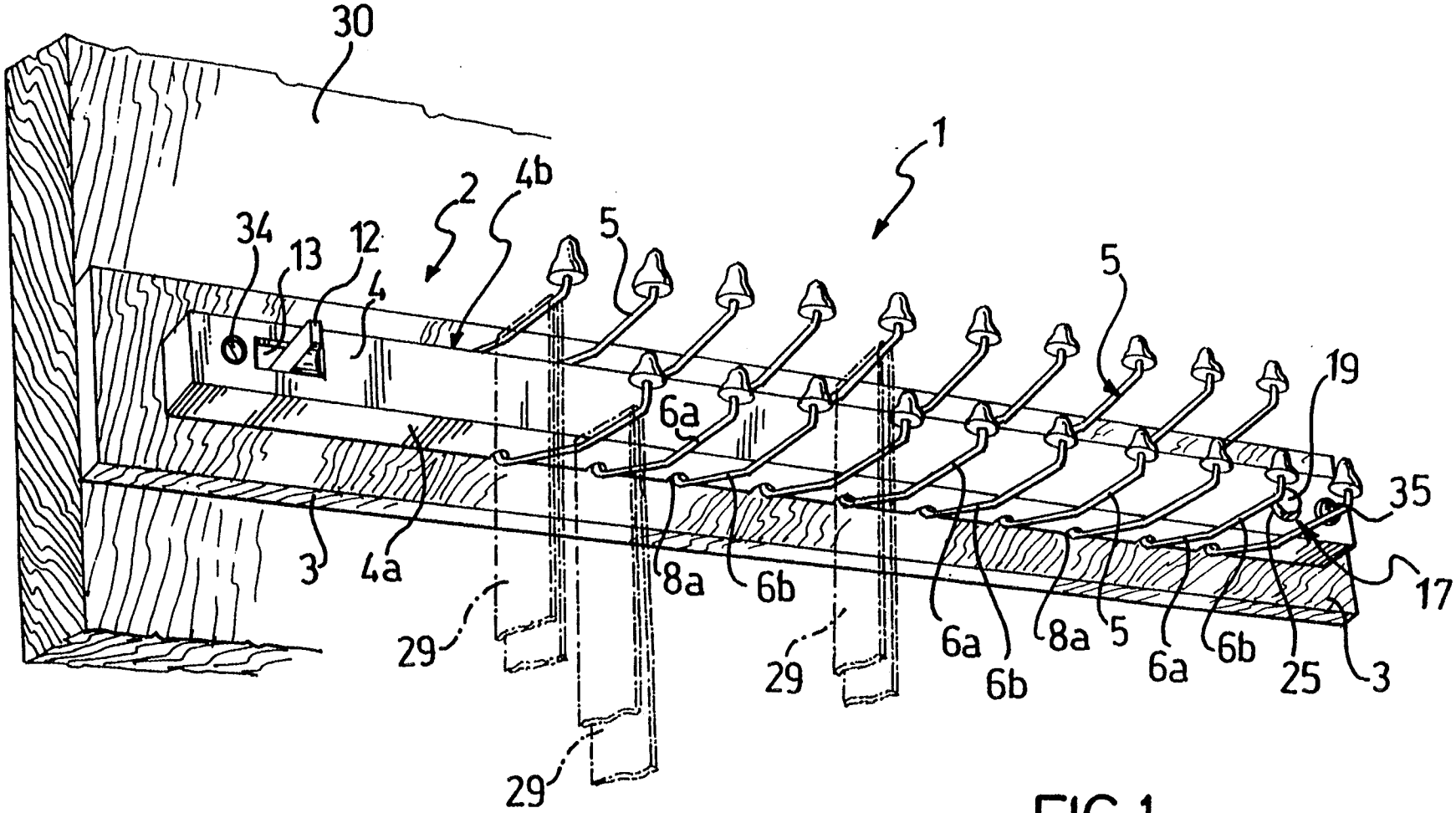

The present invention relates to tie-holder devices, of the type comprising:

a support frame, a plurality of tie-holding hooks rotatably mounted on the support frame and having respective crank shaped ends associated with a driving bar which is slidably mounted with respect to the support frame between a first position, in which the hooks are substantially parallel to said driving bar and a second position in which the hooks are substantially orthogonal to said driving bar.

The tie-holders of the type specified above which have been provided up to date are of a relatively complicated and costly construction, are not completely reliable and safe in use and are not always aesthetically appealing.

In order to overcome satisfactorily said drawbacks, the present invention provides a tie-holder device of the above indicated type, whose main feature lies in that said support frame comprises an elongated box-like body which rotatably supports the tie-holding hooks and encapsulates the crank-shaped ends of the hooks and the driving bar, said device further comprising means for holding the driving bar in any of its two end positions, said means being also encapsulated within said elongated box-like body.

The structure of the device according to the invention may be provided in various materials, such as plastics, light alloy, steel sheet metal. The main advantage of the invention lies in the provision of said box-like support body which acts on one hand as a support frame and on the other hand as a protecting cover for the mechanisms, having also an aesthetical function.

As it will become clearly apparent from the following detailed description of the preferred embodiments of the invention, mounting of the hooks on the box-like structure is easy and quick, resulting in simplicity and economy of manufacture.

In a first embodiment, the device according to the invention further comprises spring means also encapsulated within the box-like body and tending to push the driving bar towards its second position. In this case, the device further comprises disengageable latch means for holding the driving bar in its first position against the action of said spring means.

In a second embodiment, said spring means tending to push the driving bar towards its second position are not provided, and the means for holding the driving bar in any of its two end positions are formed by a U-shaped spring able to snap-engage a nose portion provided at each end of the driving bar. In this case, the driving bar is provided adjacent to each of its ends with an operating lever projecting through a slot of the box-like body. In the case of the above mentioned first embodiment, the driving bar is provided only at one end with a lever projecting through a slot of the box-like body, which is used to engage said latch means against the action of said spring means, the box-like body further bearing a push-button able to release the latch means so as to cause the automatic displacement of the driving bar towards its second position.

As it clearly appears from the foregoing description, the device according to the invention is characterised by a great simplicity of manufacture and assembling and, at the same time, due to the use of a support frame in form of a box-like body which protects all the mechanisms, it is sure and reliable in use and may be provided with shapes which are aesthetically appealing.

Figure 2:
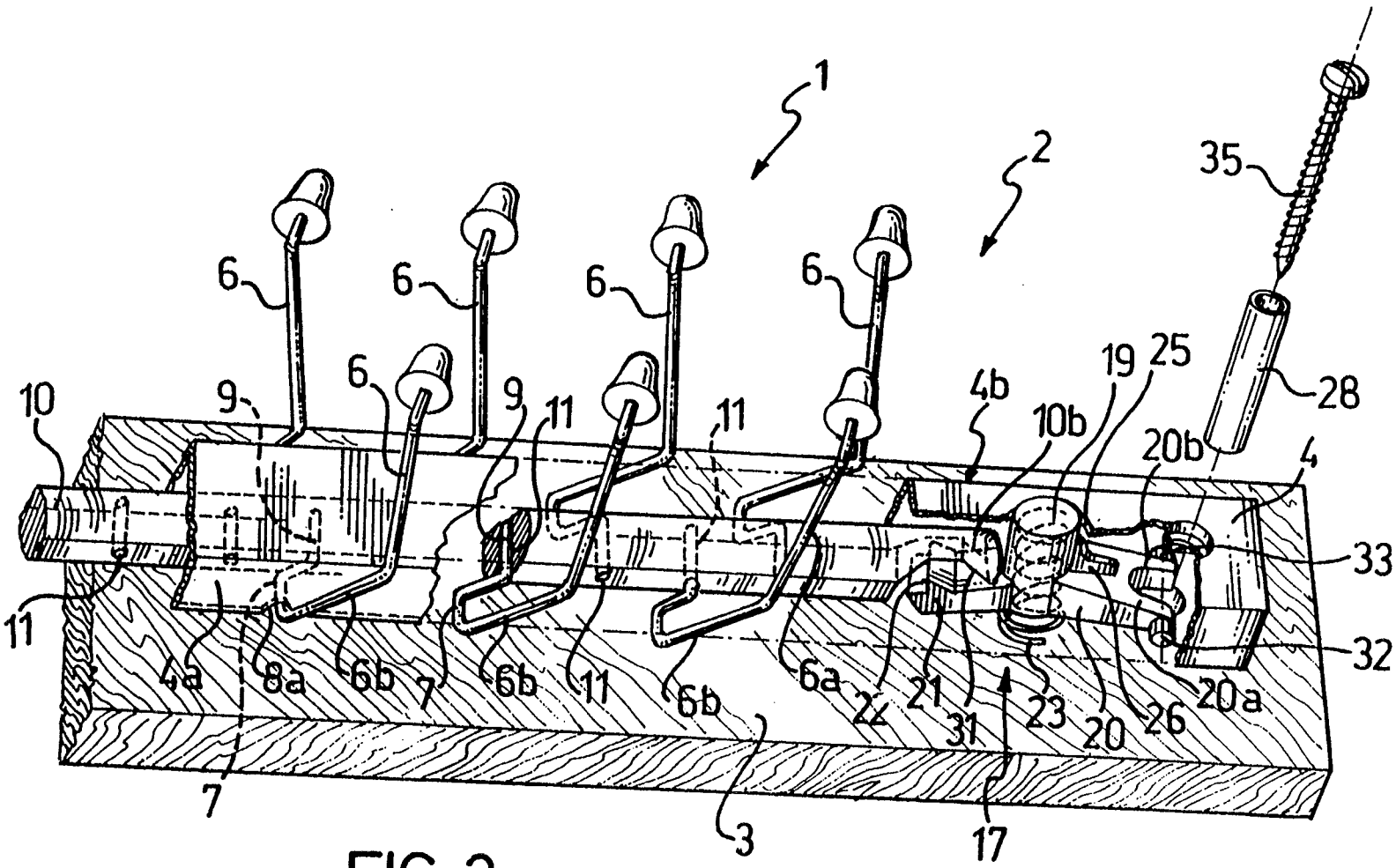
Figure 3:
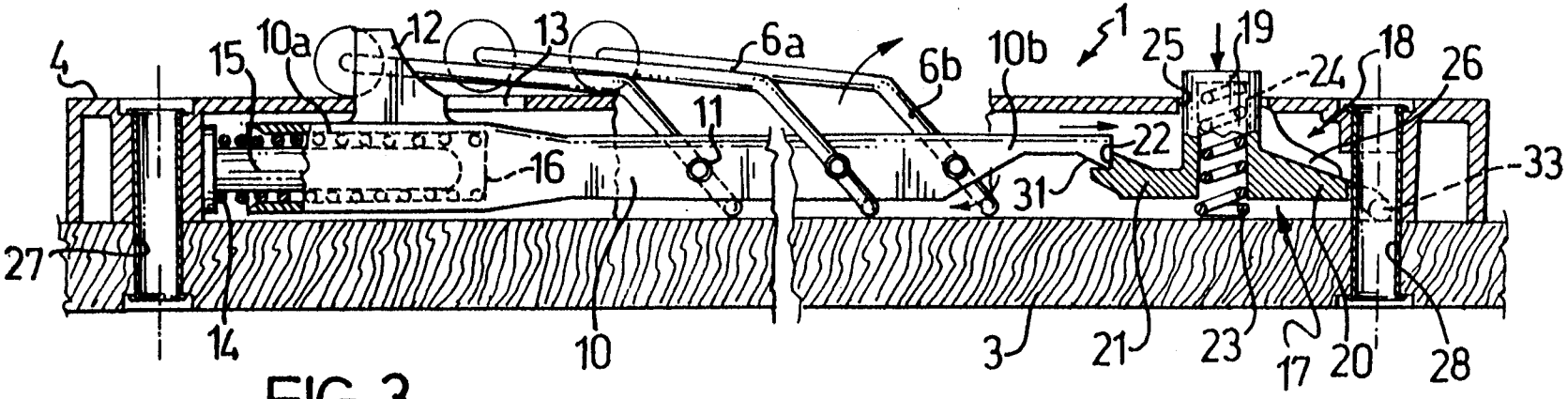
Figure 4:
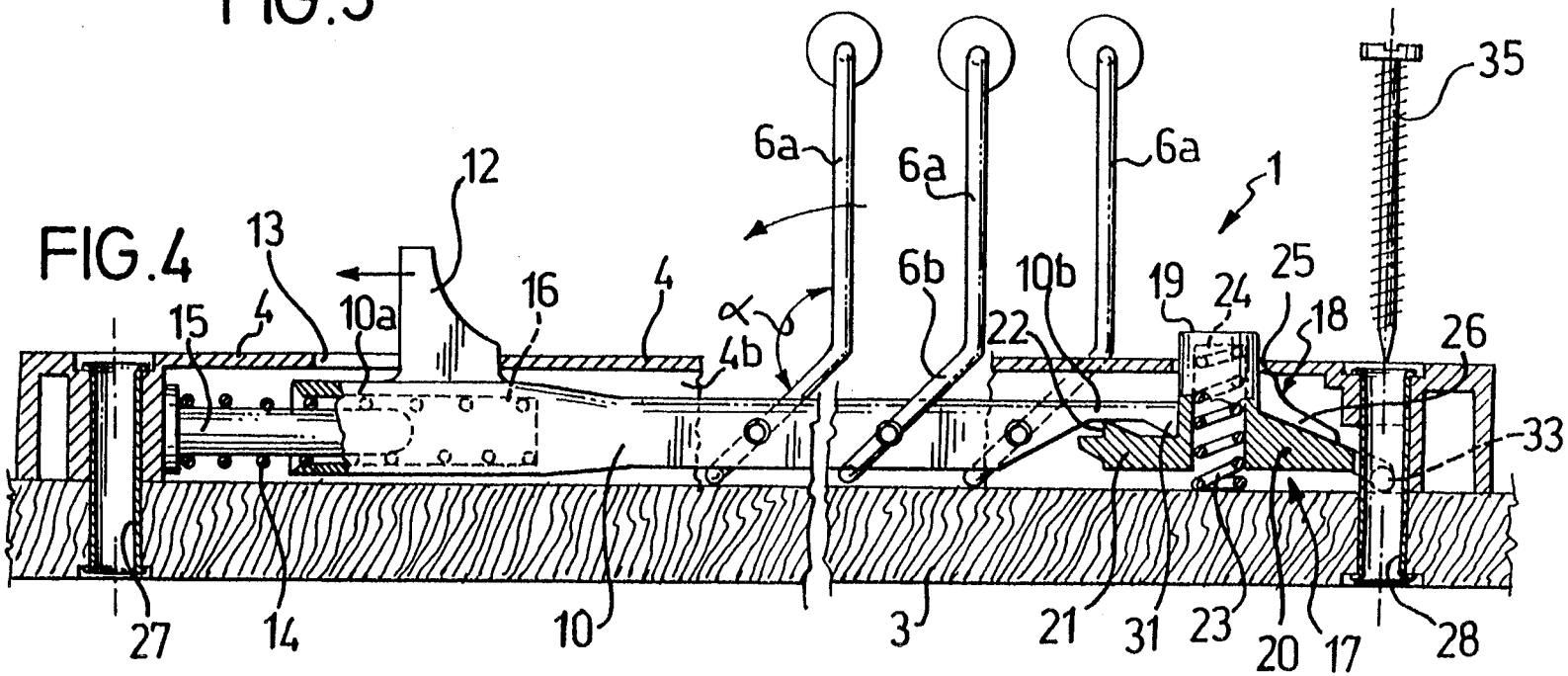
Figure 5:
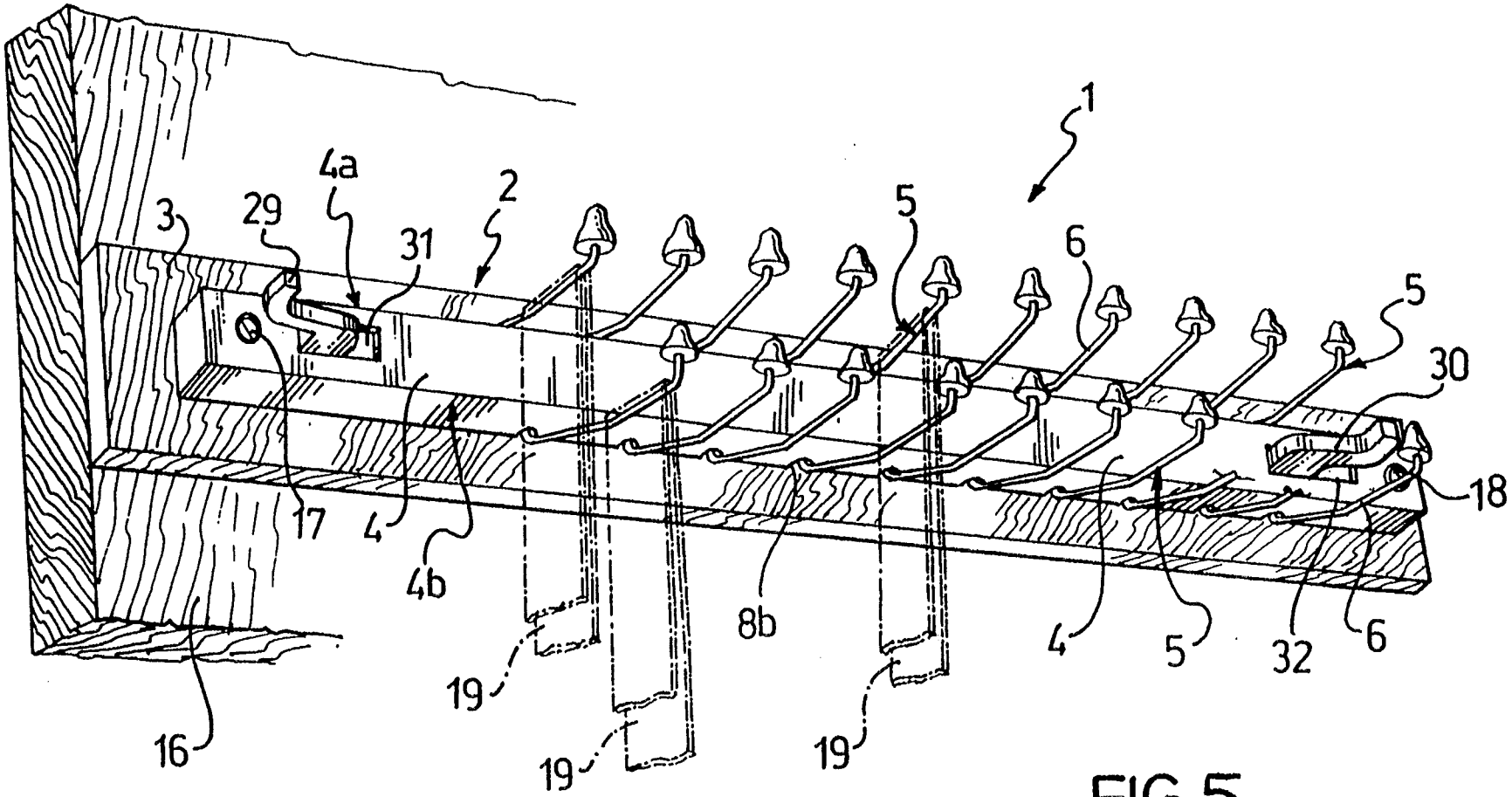
Figure 6:
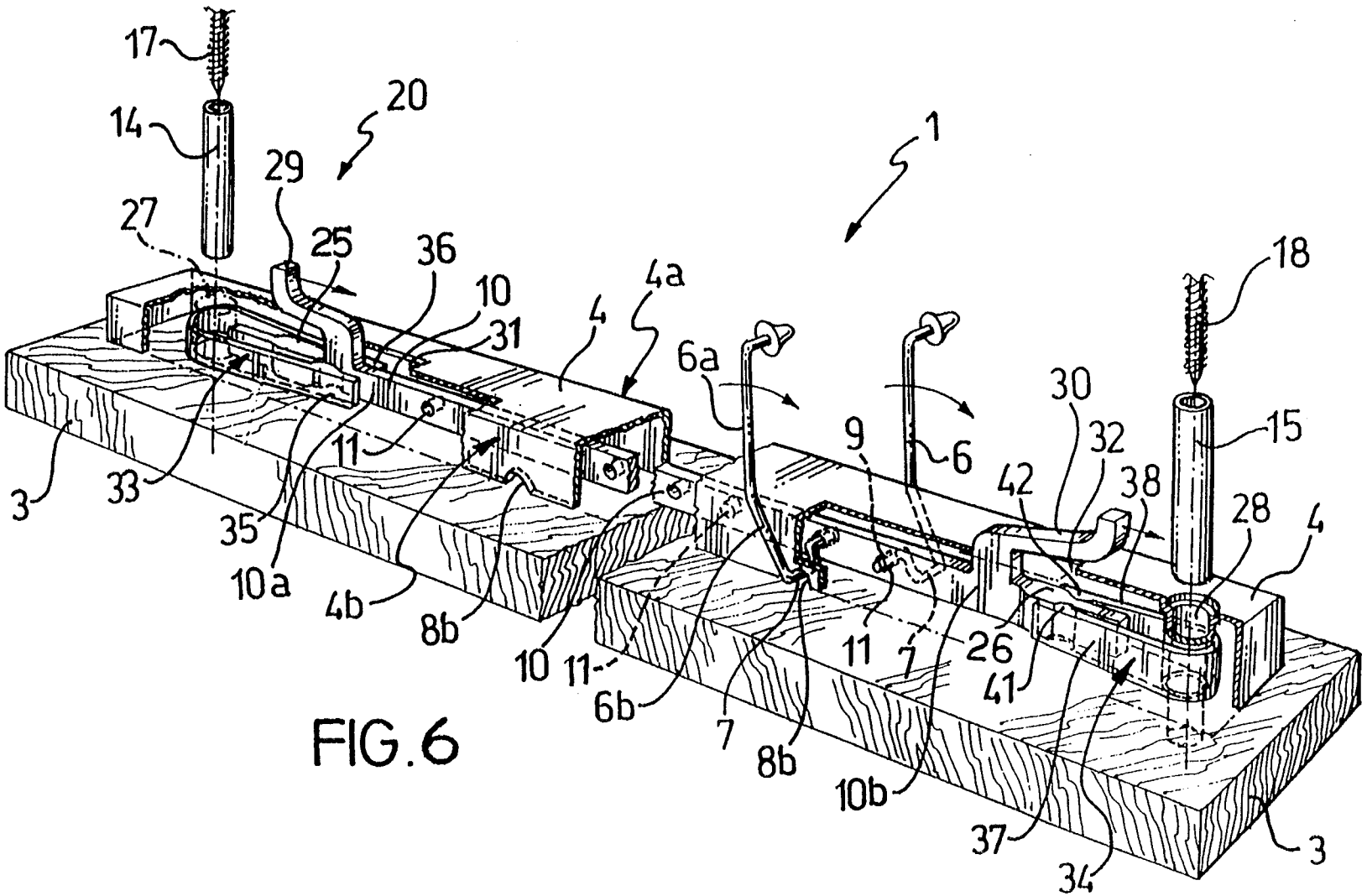
Figure 7:
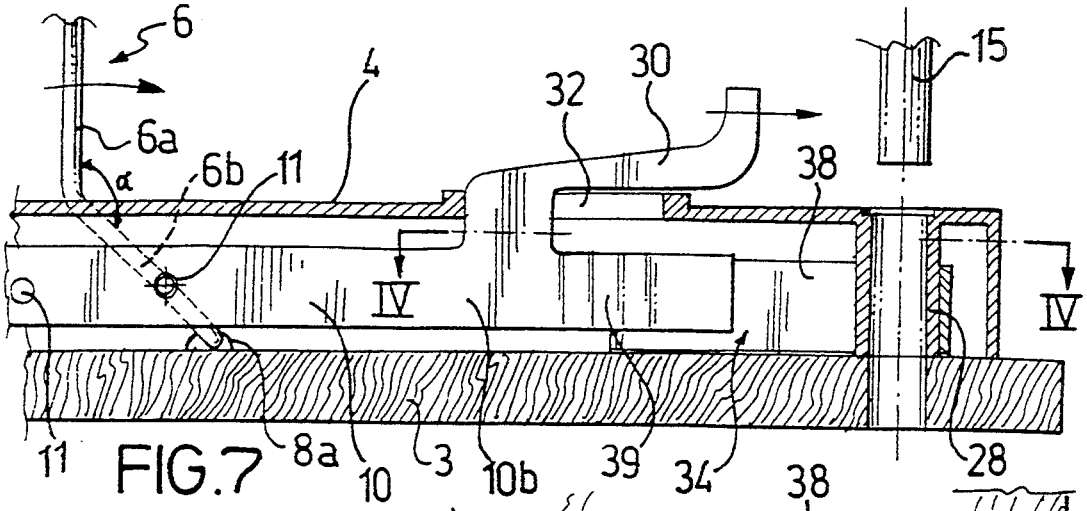
Figure 8:
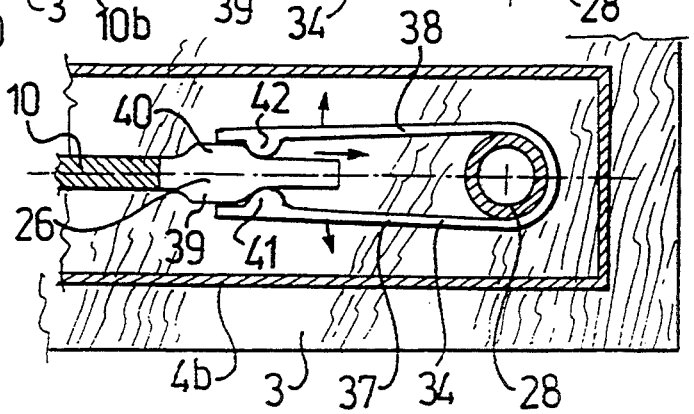
Figure 9:
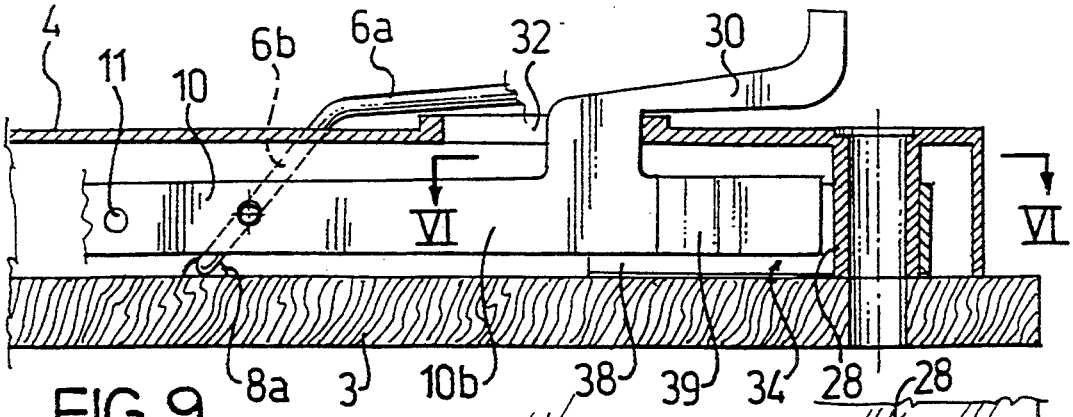
Figure 10:
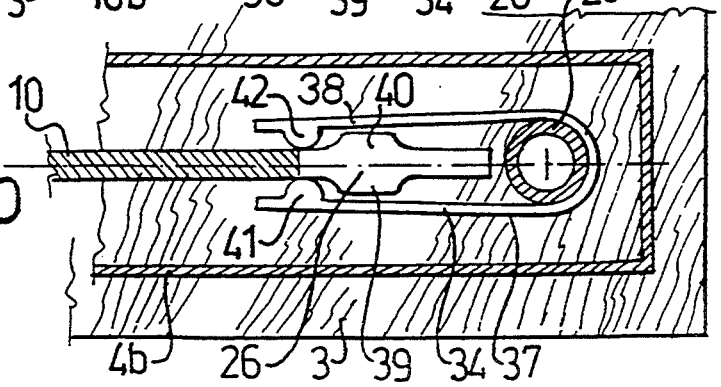

Further features and advantages of the invention will become apparent from the following description with reference to the annexed drawings, given purely by way of non limiting example, in which:

FIG. 1 shows a perspective view of a first embodiment of the tie-holder device according to the invention, FIG. 2 shows a perspective view on an enlarged scale and partially in cross-section, of some details of the device of FIG. 1, FIG. 3 shows a longitudinal cross-sectional view and on an enlarged scale of the device of FIG. 1 in a first position of use thereof, FIG. 4 shows a longitudinal cross-sectional view and on an enlarged scale of the device of FIG. 1 in a second position of use thereof, FIG. 5 shows a perspective view of a second embodiment of the tie-holder device according to the invention, FIG. 6 shows a perspective view and partially in cross-section of the device of FIG. 5, FIG. 7 shows a longitudinal cross-sectional view and on enlarged of some details of the device of FIG. 5 in a first position of use thereof, FIG. 8 shows a cross-sectional view, taken along line IV—IV of FIG. 7, of some details of the device of FIG. 1, FIG. 9 shows a longitudinal cross-sectional view and on enlarged scale of some details of the device of FIG. 5 in a second position of use thereof, FIG. 10 shows a cross-sectional view, taken along line VI—VI of FIG. 9, of some details of the device of FIG. 1.

With reference to FIGS. 1–4, numeral 1 generally designates a tie-holder device according to the invention.

Device 1 comprises a support frame 2 formed by a base 3 in form of an elongated parallelepiped on which there is mounted, by means of a pair of hollow rivets 27, 28, a box-like body 4.

Frame 2 on its-turn is fixed to a support element 30, such as a door of a piece of furniture, by means of screws 34, 35 respectively received within rivets 27, 28.

Device 1 further comprises a plurality of hooks 5 for holding ties or the like, indicated by 29 in FIG. 1, the hooks being rotatably mounted on frame 2.

More in detail, hooks 5 are pivoted on opposite sides, respectively upper side 4*a* and lower side 4*b*, of the box-like body 4, so as to form two parallel superimposed rows offset from each other.

Each hook 5 comprises an arm 6, for holding a tie or the like, an intermediate portion 7, forming an angle approximately of 90 degrees with arm 6, and a free end 9, substantially crank-shaped.

According to an advantageous feature of the invention, arm 6 comprises two portions 6*a*, 6*b* forming an angle $\alpha$ of a predetermined value therebetween, comprised between 120 degrees and 140 degrees and preferably of 135 degrees.

Each hook 5 is also pivoted to the box-like body 4 due to the portion 7 received in respective seats 8*a*, 8*b*, semicircular in shape, formed on sides 4*a*, 4*b* of body 4, each hook 5 being associated with a bar slidably mounted within the box-like body 4.

More in detail, the free ends 9 of hooks 5 are received in a plurality of holes 11 formed in bar 10.

The latter is provided at a first end 10*a* with a operating bush-button 12 which on its turn is slidably mounted in a respective seat 13 formed in the box-like body 4.

At said end 10*a*, bar 10 is subject to respective spring means 14, such as a helical spring, mounted on a spring guide 15 and received in a respective conjugated seat 16 axially formed within bar 10.

At the opposite end 10*b* of bar 10 there is formed in one piece a tooth 31 cooperating with means 17 for removably holding bar 10 in opposite positions in which hooks 5 are respectively closed and opened.

Said means 17 comprises a latch device 18 including a button 19 pivoted to the box-like body 4 by means of a first arm 20 and cooperating with bar 10 by means of a second arm 21.

To this end, arm 21 is provided with a stop tooth 22 for removably engaging tooth 31 formed in an end 10*b* of bar 10.

With reference to FIG. 2, it is to be noted that arm 20 has a U-shaped portion comprising two wings 20*a*, 20*b* between which there is defined a seat for receiving the hollow rivet 28.

At the ends of wings 20*a*, 20*b* there are also formed cylindrical appendages 32, 33 forming respective pins to allow angular movements of the latch device 18.

Button 19 is also subject to the action of respective spring means 23, such as a helical spring, received in a respective conjugated seat 24 formed in the button itself, button 19 being slidably mounted in an aperture 25 formed in the box-like body 4. From this aperture 25, button 19 projects for a predetermined length, defined by the abutment between a stop surface 26 formed on first arm 20 and the edge of aperture 25.

The operation of the above described device will be illustrated with particular reference to FIGS. 3 and 4 in which it is shown in two different operative conditions.

In a first operative condition, in which hooks 5 are closed, bar 10 is held in a first position against the action of the spring means 14 by the stop tooth 22 of the latch device 18 (FIG. 3).

In this position of bar 10, portions 6*a* of arms 6 are adjacent to frame 2 and hold ties 29 lying thereon.

When one wishes to open hooks 5, it is sufficient to push the push button 19 against spring means 23.

Thus, tooth 31 formed at the end 10*b* of bar 10 disengages from stop tooth 22 and the bar is free to move inside the box-like body 4 and is pushed by spring means 14 in a second position defined by abutment thereof against the body of button 19.

As a result of the movement of bar 10, arms 6 rotate towards their opened position by an angle of a predetermined amplitude, approximately of 90 degrees, and reach the position illustrated in FIG. 4.

In this operative condition, portions 6*a* of arms 6 extend substantially orthogonally to the box-like body 4 allowing one or more ties to be picked up or stored.

Advantageously, by suitably dimensioning spring means 14, the movement of bar 10 and hence the opening rotation of hooks 5 takes place progressively and smoothly.

To bring hooks 5 back to their closed position, it is sufficient to push the operating button 12 moving bar 10 against the action of the spring means 14, so as to bring tooth 31 back in engagement with the corresponding stop tooth 22 of the latch device 18.

Also in this case, due to the shape of arm 21 and the end 10*b* of bar 10, the backward movement of the latter in the start position takes place in an extremely progressive manner and smoothly.

Various tests have shown that the above described device has an operation which is safe and reliable with the time. The good operation of the device is particularly ensured by the box-like body 4 which fulfils the function of supporting, guiding and protecting all the moving parts. The device has the further advantage of an extremely easy assembling which can be carried out by means of the hollow rivets 27, 28 which connect the box-like body 4 to the base 3. The same hollow rivets 27, 28 allow also the device 1 to be mounted on the support surface 30, such as the door of a piece of furniture, by means of screws 34, 35.

The reduced size of device 1 allows two or more box-like bodies to be mounted on a same base 3, thus varying at will the number of available hooks.

Hooks 5 and the other parts of device 1 can be made of metal or plastics with automatic apparatus and with a minimum number of operators, to the advantage of the production costs.

In the following, the embodiment which is illustrated in FIGS. 5–10 will be described.

With reference to FIGS. 5–10, also in this case, reference numeral 1 generally designates the tie-holder device.

Device 1 comprises a support frame 2 formed by a base 3 on which there is mounted a box-like body 4 by means of a pair of hollow rivets 14, 15, received in respective tubular seats 27, 28.

Frame 2 on its turn is fixed to a support element 16, such as a door of a piece of furniture, by means of screws 17, 18 respectively received within rivets 14, 15.

Device 1 further comprises a plurality of hooks 5 for supporting ties or the like indicated by 19 in FIG. 5, the hooks being rotatably mounted on frame 2.

More in detail, hooks 5 are pivoted on opposite sides, respectively upper side 4*a* and lower side 4*b*, of the box-like body 4 so as to form two parallel superimposed rows offset from each other.

Each hook 5 comprises an arm 6, for supporting a tie or the like, an intermediate portion 7, forming with arm 6 an angle approximately of 90 degrees and a free end 9, substantially crank-shaped.

According to an advantageous feature of the present invention, the arm 6 comprises two portions 6*a*, 6*b* forming an angle $\alpha$ therebetween of a predetermined value, comprised between 120 degrees and 140 degrees and preferably of 135 degrees.

Each hook 5 is also pivoted to the box-like body 4 due to the portion 7 received in respective conjugated seats 8*a*, 8*b* semicircular in shape on sides 4*a*, 4*b* of body 4 and is associated with a bar 10 slidably mounted within the box-like body 4.

More in detail, the free ends 9 of hooks 5 are received in a plurality of holes 11 formed in bar 10.

The latter is provided at opposite ends 10*a*, 10*b* with driving means, generally designated by 20, including, in a preferred form, a pair of levers 29, 30 formed in one piece with bar 10.

Levers 29, 30 are substantially S-shaped for a convenient manual operation and are movably guided in respective apertures 31, 32 which are slot-shaped, formed in the box-like body 4, between opposite positions defined by the abutment against opposite edges of such slots.

According to a feature of the present invention, device 1 further comprises a pair of springs 33, 34 substantially U-shaped, respectively associated with ends 10*a*, 10*b* of bar 10 and generally constituting means for removably holding bar 10 in opposite positions in which hooks 5 are respectively opened and closed.

Springs 33, 34, mounted on opposite sides of tubular seats 27, 28, are provided with planar wings indicated with numerals 35–38, cooperating by snap engagement with a pair of stop portions 25, 26 formed at ends 10*a*, 10*b* of bar 10 adjacent to levers 29, 30.

In a preferred embodiment, each of said stop portions 25, 26 comprises two teeth longitudinally formed on opposite sides of bar 10 and having tapered sides, whereas wings 35–38 of the springs are provided with projections substantially semicircular in shape, cooperating with said teeth.

The structure of the springs and the stop portions is particularly shown in FIGS. 7–10: in such figures, numerals 39 and 40 designate the opposite teeth of stop portion 26, whereas 41, 42 designate the projections of spring 34 which are to cooperate therewith.

Although they have not been shown in detail, the structures of stop portion 25 and spring 33 are absolutely similar.

The operation of the above described device is as follows.

In a first operative condition, in which hooks 5 are closed, bar 10 is held positively in position by spring 34, so as to hold portions 6*a* of arms 6 adjacent to frame 2. In this condition, shown in FIGS. 9, 10, stop portion 26, formed at the end 10*b* of bar 10 is completely received between wings 37 and 38 of spring 34: any movement of bar 10 is thus prevented by the abutment between teeth 39, 40 of stop portion 26 and projections 41, 42 of spring 34, as well as, on the opposite end 10*a* of bar 10, by the abutment of stop portion 25 against projections of spring 33.

When one wishes to open hooks 5, it is sufficient to act on levers 29 and 30 so as to bring bar 10 in the position illustrated in FIGS. 5, 6 and 7.

This movement takes place only by overcoming the resistance opposed by springs 33 and 34 cooperating by snap engagement with stop portions 25 and 26.

Once the movement of the bar has taken place, levers 29, 30 abut against the edges of slots 31, 32, the stop portion 25 is engaged between wings 35, 36 of spring 33 and the stop portion 26 escapes from spring 34.

In this manner, a second stable position of the bar 10 is achieved, in which hooks 5 are positively held in an opened condition without any possibility of their closing due to inadvertent hits.

It is to be noted that, as a result of a movement of bar 10, arms 6 rotate towards their opened condition by an angle of a predetermined amplitude, approximately of 90 degrees, so as to reach an operative condition in which their portions 6*a* extend substantially orthogonally to the box-like body 4 thus allowing one or more ties to be picked up or stored.

By acting on levers 29, 30, hooks 5 can then be brought back in their closed condition by moving rearwardly bar 10 so as to bring it back to the start condition illustrated in FIGS. 5 and 6.

Various tests have shown that by suitably dimensioning stop portions 25 and 26 and springs 33 and 34, the tie holder device of the present invention has a safe and reliable operation with a progressive and smooth movement of hooks 5 and bar 10.

Also in this case, the good operation of the device is particularly ensured by the box-like body 4 which fulfils the function of supporting, guiding and protecting all the moving parts. Also in this case, furthermore, the assembling of the hooks is simple and quick and is absolutely similar to what has been described with reference to FIGS. 1–4. Also all the remaining advantages which have been cited above with reference to the first embodiment of the invention are also achieved by the embodiment shown in FIGS. 5–10.

Naturally, while the principle of the invention remains the same, the detail of construction and the embodiments may widely vary with respect to what has been described and shown purely by way of example, without departing from the scope of the present invention.

We claim:

1. Tie-holder device, comprising a support frame, a plurality of tie-holding hooks, rotatably mounted on the support frame and having respective crank-shaped ends associated with a driving bar which is slidably mounted with respect to said support frame between a first position in which the hooks are parallel to said driving bar and a second position in which the hooks are substantially orthogonal with respect to the driving bar, wherein said support frame comprises an elongated box-like body which rotatably supports the hooks and encapsulates the crank-shaped ends of the hooks, and the driving bar, said device further comprising means for holding the driving bar in any of its two positions, said means being also encapsulated within said box-like body.

2. Device according to claim 1, wherein said means comprises spring means tending to push the driving bar towards its second position and disengageable latch means for holding the driving bar in its first position against the action of said spring means.

3. Device according to claim 1, wherein said hooks are rotatably mounted within conjugated seats formed in the box-like body.

4. Device according to claim 1, wherein said hooks are rotatably mounted on opposite sides of the box-like body.

5. Device according to claim 2, wherein said box-like body is associated with a support base by means of a plurality of hollow rivets.

6. Device according to claim 2, wherein said spring means comprises a helical spring received in a respective seat axially formed at a first end of said bar.

7. Device according to claim 2, wherein said bar comprises an operating button slidably mounted in a respective seat formed in said box-like body.

8. Device according to claim 2, wherein said latch means comprise a latch element pivotally mounted within said box-like body and provided with a stop tooth cooperating with a tooth formed at a second end of said bar.

9. Device according to claim 8, wherein said latch element further comprises a button slidably mounted within an aperture formed in the box-like body.

10. Device according to claim 1, wherein said hooks comprise arms having adjacent portions forming an angle of a predetermined amplitude therebetween.

11. Device according to claim 10, wherein said angle is comprised between 120 degrees and 140 degrees.

12. Device according to claim 1, wherein said means comprise a U-shaped spring associated with each end of the driving bar and able to snap-engage the respective end of the driving bar.

13. Device according to claim 12, wherein the driving bar is provided at each of its ends with an operating lever projecting through an aperture of the box-like body.

14. Device according to claim 12, wherein each wing of said U-shaped springs is provided inwardly with a projection cooperating with a respective tooth formed on a respective side of the cooperating end of the driving bar.

* * * * *